US007301284B2

(12) United States Patent
Ito et al.

(10) Patent No.: US 7,301,284 B2
(45) Date of Patent: Nov. 27, 2007

(54) LIGHTING CONTROL CIRCUIT FOR VEHICLE LIGHTING EQUIPMENT

(75) Inventors: Masayasu Ito, Shizuoka (JP); Hitoshi Takeda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 32 days.

(21) Appl. No.: 11/225,250

(22) Filed: Sep. 13, 2005

(65) Prior Publication Data

US 2006/0061301 A1 Mar. 23, 2006

(30) Foreign Application Priority Data

Sep. 17, 2004 (JP) ..... 2004-271202

(51) Int. Cl.
*H05B 37/02* (2006.01)

(52) U.S. Cl. ..... 315/82; 315/291; 307/10.8

(58) Field of Classification Search ..... 315/82, 315/291; 307/10.8; 362/487
See application file for complete search history.

(56) References Cited

U.S. PATENT DOCUMENTS 5,924,784 A * 7/1999 Chliwnyj et al. ..... 362/234

FOREIGN PATENT DOCUMENTS

| | | |
|---|---|---|
| JP | 10-86746 | 4/1998 |
| JP | 2001-215913 | 8/2001 |
| JP | 2004-134147 | 4/2004 |

OTHER PUBLICATIONS

Patent Abstracts of Japan, Publication No.: 2001-215913, Publication Date: Aug. 10, 2001, 1 page.
Patent Abstracts of Japan, Publication No.: 10-086746, Publication Date: Apr. 7, 1998, 1 page.
Patent Abstracts of Japan, Publication No.: 2004-134147, Publication Date: Apr. 30, 2004, 1 page.

* cited by examiner

*Primary Examiner*—David H. Vu
(74) *Attorney, Agent, or Firm*—Osha Liang LLP

(57) ABSTRACT

When an H signal of H/L binary signals is input into a control signal input terminal, a PWM signal is output from a multivibrator. When this PWM signal is input into a power supply circuit via a voltage converter circuit, such a control is repeated that a rated current flows through an LED at an ON time of the PWM signal and a supply of current to the LED is stopped at an OFF time of the PWM signal. An average current flowing through the LED is lowered and thus an emission of light is weakened, nevertheless an emitted light of the LED can be kept white because the rated current is supplied to the LED while the LED emits the light.

2 Claims, 7 Drawing Sheets

FIG. 7 (a) PWM SIGNAL
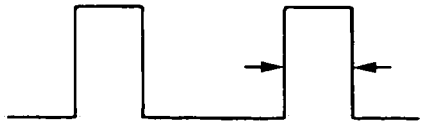
FIG. 7 (b) WAVEFORM AT A POINT
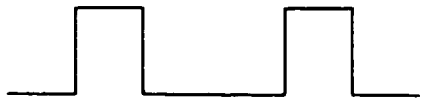
FIG. 7 (c) WAVEFORM AT B POINT
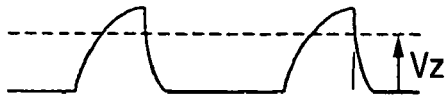
FIG. 7 (d) WAVEFORM AT C POINT
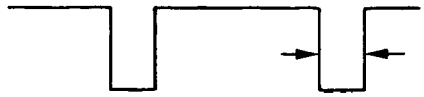
FIG. 7 (e) DUTY OUTPUT
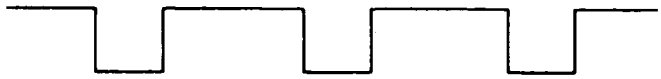
FIG. 7 (f) SWITCHING ELEMENT ON/OFF
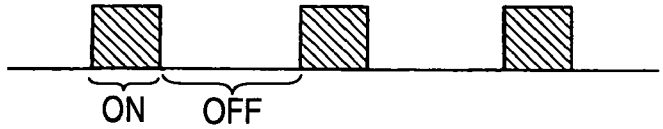
FIG. 7 (g) CURRENT TO LED
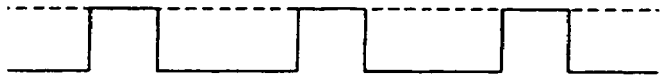

LIGHTING CONTROL CIRCUIT FOR VEHICLE LIGHTING EQUIPMENT

BACKGROUND OF THE INVENTION

1. Technical Field

The present invention relates to a lighting control circuit for vehicle lighting equipment and, more particularly, a lighting control circuit for vehicle lighting equipment constructed to control the lightening of a semiconductor light source that is formed of a semiconductor light emitting device.

2. Related Art

In the prior art, as the vehicle lighting equipment, the equipment using a semiconductor light emitting device such as LED (Light Emitting Diode), or the like as a light source is known. Also, the vehicle lighting equipment of this type is equipped with a lighting control circuit that controls the lighting of the LED.

As the lighting control circuit for the vehicle lighting equipment, for example, as shown in FIG.8, such a circuit is known that a converter circuit 1 is connected to a light emitting unit 3 consisting of light emitting diodes LEDs 11 to 1*n*, and a DC power is supplied from the converter circuit 1 to the light emitting unit 3, while controlling an output voltage of the converter circuit 1 such that a terminal voltage of a constant-current circuit 2 is maintained constant (see JP-A-2001-215913 (page 4 to page 5, FIG. 1)). According to this lighting control circuit for the vehicle lighting equipment, a ripple component can be removed from the output voltage of the converter circuit 1 by utilizing a current stabilizing action of the constant-current circuit 2.

In northern Europe, North America, and others, particularly in the district where an amount of solar radiation is small even in the daytime of winter, the driver is bound to turn on the headlamp of his or her car in the daytime, i.e., DRL (Daytime Running Light). Therefore, in the vehicle such as the car, or the like sold in these countries, the lamp control system that is used to turn on the headlamp in a dimmed lighting mode even in the daytime is employed (see JP-A-10-86746 (page 2 to page 5, FIG. 1)).

In turning on the vehicle headlamp as the DRL, the LEDs can be turned on in a dimmed lighting mode by supplying the power or the current, which is smaller than the power or the current in a full lighting mode, to the LEDs of the high-beam headlamp. For example, in the case where the constant-current circuit is utilized, if a current value is set to the current that is smaller than the current in a full lighting mode and then the set constant current is supplied to the LEDs, the LEDs can be turned on in a dimmed lighting mode.

Also, if a PWM (Pulse Width Modulation) signal, for example, is input directly to the LEDs and then supply/cutting-off of the power to the LEDs are repeated in accordance with the PWM signal, the LEDs can be turned on in a dimmed lighting mode. Also, if the PWM signal is input into a switching element of a switching regulator, which drives the LEDs by the constant current, and then the switching regulator is driven in accordance with the PWM signal, the LEDs can be turned on in a dimmed lighting mode. The PWM signal is defined as such a signal that has a frequency in a range of several hundreds Hz to several tens kHz, for example, and turns on/off the power (voltage/current) request at a particular duty ratio.

For example, in the case where the switching regulator is driven by the PWM signal that is input into the switching element and has a duty ratio of 50%, such switching regulator is caused to misunderstand that, when the duty ratio of the PWM signal is set to 50%, half of the particular constant current value that the switching regulator now controls has already been supplied. Then, the switching regulator supplies only half of the current required in a full lighting mode to the LEDs, and thus the brightness of the LEDs gives a quantity of light corresponding to such current. As the method of causing the switching regulator to misunderstand, the PWM signal is converted into a DC voltage and then this DC voltage value is reflected on feed-back control of the switching regulator. There are various methods such as the method of reflecting this DC voltage value on a current sensed value, for example. In this manner, the headlamp can be turned on in a dimmed lighting mode at any brightness by adjusting the duty ratio of the PWM signal to any value.

SUMMARY OF THE INVENTION

In turning on the high-beam headlamp in a dimmed lighting mode as the DRL, the approach of reducing the current supplied to the LEDs is employed. In this event, if the current supplied to the LEDs is reduced simply, in some cases a change of chromaticity is caused according to the LEDs.

For example, even in the LED that emits a white light by receiving a rated current in a full lighting mode, if an average current is reduced simply by decreasing the current that is fed to the LED in a dimmed lighting mode, sometimes a blue color component of the emitted light of the LED is reduced gradually and then the LED emits the light of a greenish color.

One or more embodiments of the present invention prevent generation of a change of chromaticity in a semiconductor light source when the semiconductor light source is turned on in a dimmed lighting mode.

In accordance with one or more embodiments, a lighting control circuit for vehicle lighting equipment comprises current supplying means for controlling a supply of current to a semiconductor light source based on an on/off control signal, while using an input voltage from a power supply as a luminous energy of the semiconductor light source; wherein the current supplying means supplies a specified current to the semiconductor light source when the on/off control signal is at one logical level, and stops the supply of current to the semiconductor light source when the on/off control signal is at other logical level.

(Effect) In the situation that the current is supplied to the semiconductor light source based on the on/off control signal, such a control is carried out that the specified current, e.g., the rated current is supplied to the semiconductor light source when the on/off control signal is at one logical level, while the supply of current to the semiconductor light source is stopped when the on/off control signal is at the other logical level. Therefore, in a total period during which the semiconductor light source is to be turned on in a dimmed lighting mode, an average value of the current supplied to the semiconductor light source is reduced and an emission of light is weakened, nevertheless the specified current is supplied to the semiconductor light source when the semiconductor light source is to be turned on and thus the specified chromaticity can be still maintained while the semiconductor light source emits the light. As a result, when the semiconductor light source is turned on in a dimmed lighting mode, it can be prevented that a change of chromaticity is generated in the semiconductor light source.

In accordance with one or more embodiments, the lighting control circuit for the vehicle lighting equipment further comprises signal converting means for converting a binary signal into an on/off control signal having a designated duty ratio in response to one signal of the binary signal, and outputting the control signal to the current supplying means.

(Effect) The binary signal is converted into the on/off control signal having the designated duty ratio. Therefore, even when the binary signal is input as the control signal, the semiconductor light source can be turned on in a dimmed lighting mode based on the binary signal.

In accordance with one or more embodiments, the lighting control circuit for the vehicle lighting equipment further comprises control signal correcting means for correcting the duty ratio of the on/off control signal in response to characteristics of the semiconductor light source, and outputting the corrected on/off control signal to the current supplying means.

(Effect) The duty ratio of the on/off control signal is corrected in response to characteristics of the semiconductor light source. Therefore, even when the on/off control signal used to turn on the light source, e.g., the halogen lamp, having different characteristics from those of the semiconductor light source as the lighting object, e.g., LED, in a dimmed lighting mode is input, a quantity of emitted light of the semiconductor light source (LED) as the lighting object can be made equal to a quantity of emitted light of the light source (halogen lamp) having different characteristics.

As apparent from the above explanation, embodiments of the present invention may include one or more of the following advantages. In accordance with one or more embodiments, the lighting control circuit for the vehicle lighting equipment can prevent generation of a change of chromaticity in the semiconductor light source.

In accordance with one or more embodiments, the semiconductor light source can be turned on in a dimmed lighting mode based on the binary signal.

In accordance with one or more embodiments, a quantity of emitted light of the semiconductor light source as the lighting object can be set to conform to a quantity of emitted light of the light source having different characteristics.

BRIEF DESCRIPTION OF THE DRAWINGS

FIG. 7 A waveform diagram explaining an operation of the lighting control circuit for the vehicle lighting equipment shown in FIG. 6.

DETAILED DESCRIPTION OF THE INVENTION

Figure 1:
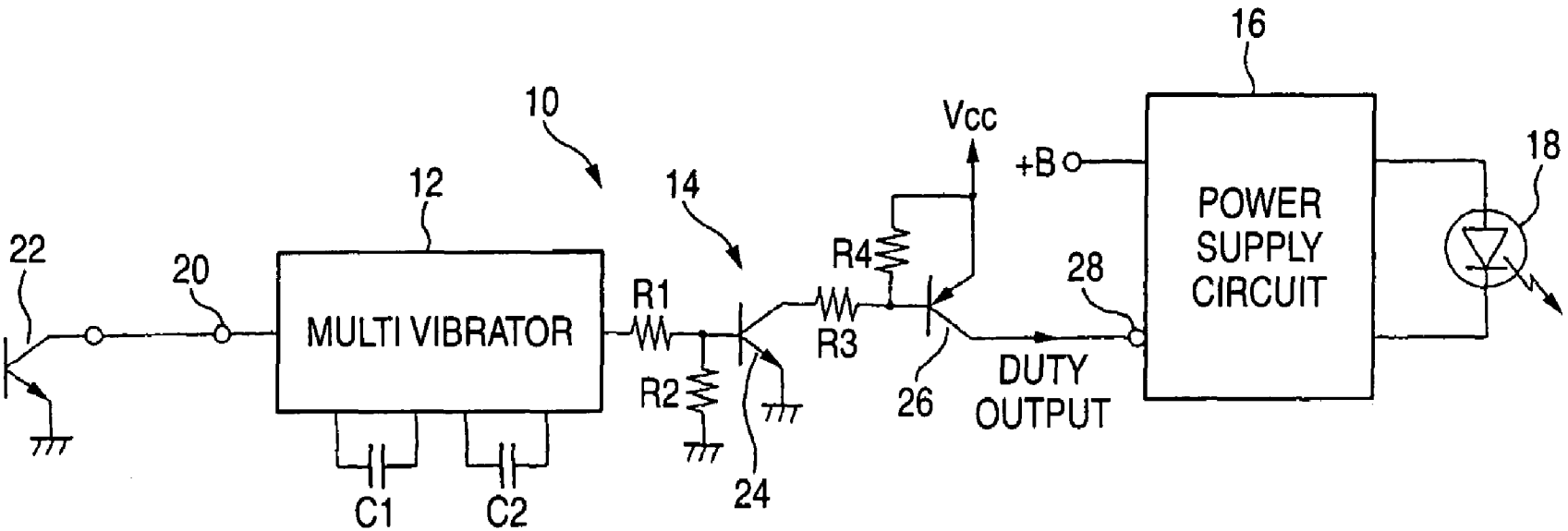
FIG. 1 A circuit diagram of a lighting control circuit for vehicle lighting equipment showing a first embodiment of the present invention.
Figure 2:
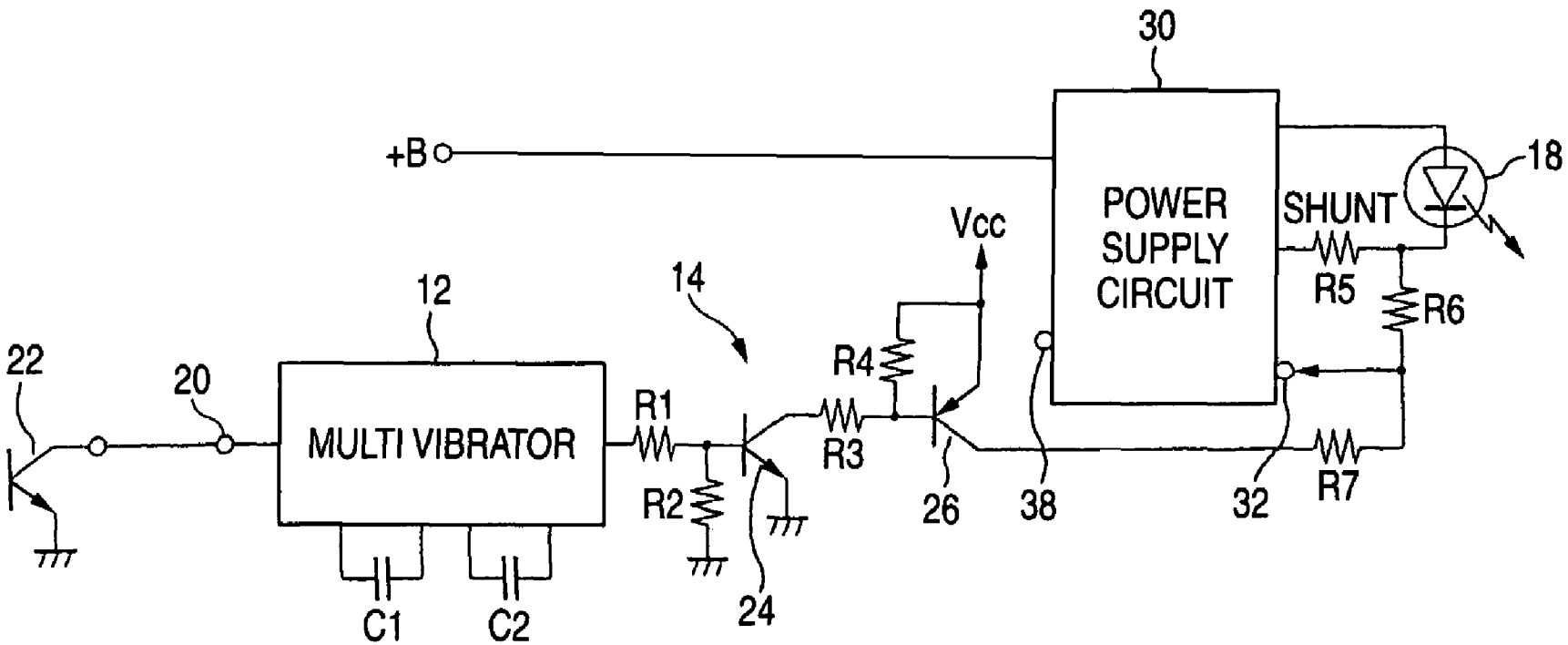
FIG. 2 A circuit diagram of a lighting control circuit for vehicle lighting equipment showing a second embodiment of the present invention.
Figure 3:
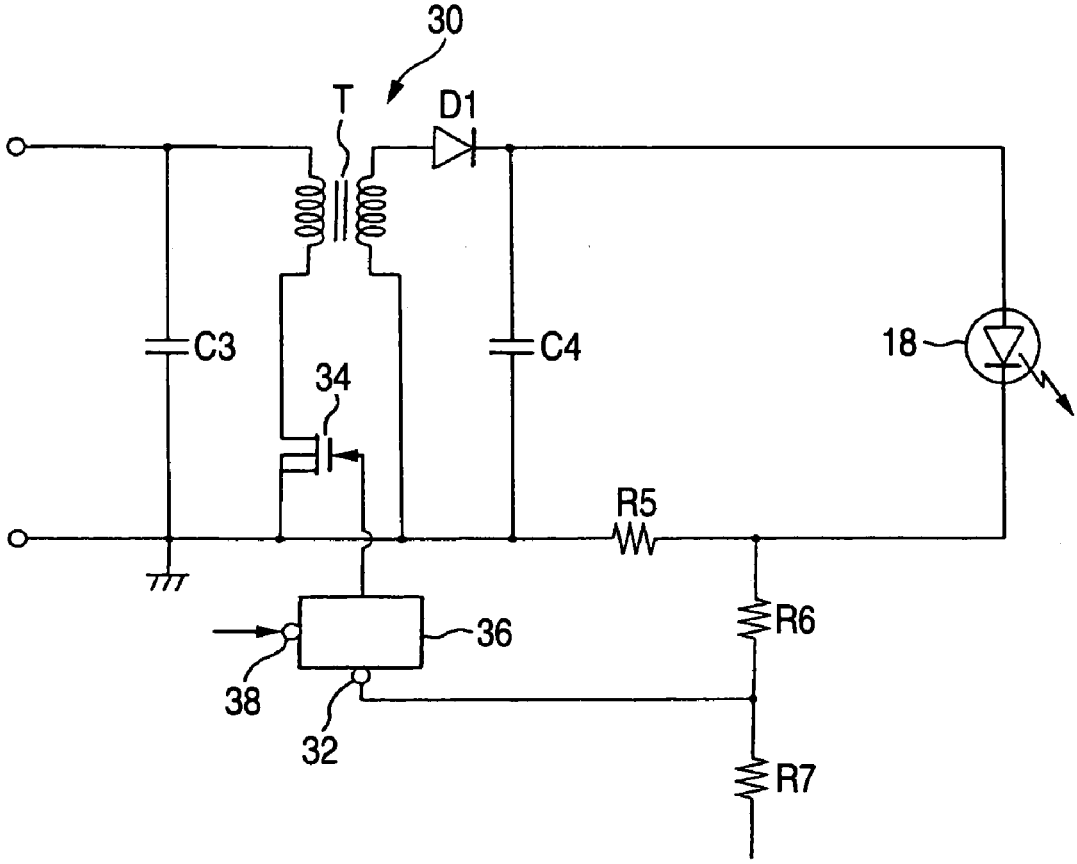
FIG. 3 A circuit diagram of a power supply circuit.
Figure 4:
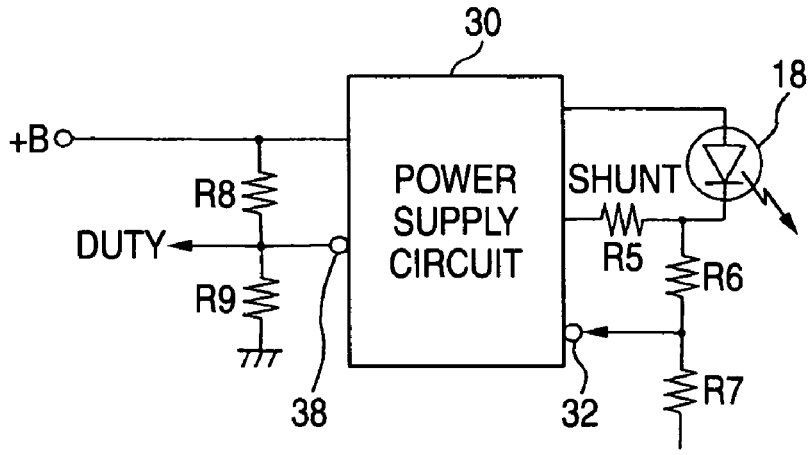
FIG. 4 A pertinent circuit diagram of a lighting control circuit for vehicle lighting equipment showing a third embodiment of the present invention.
Figure 5:
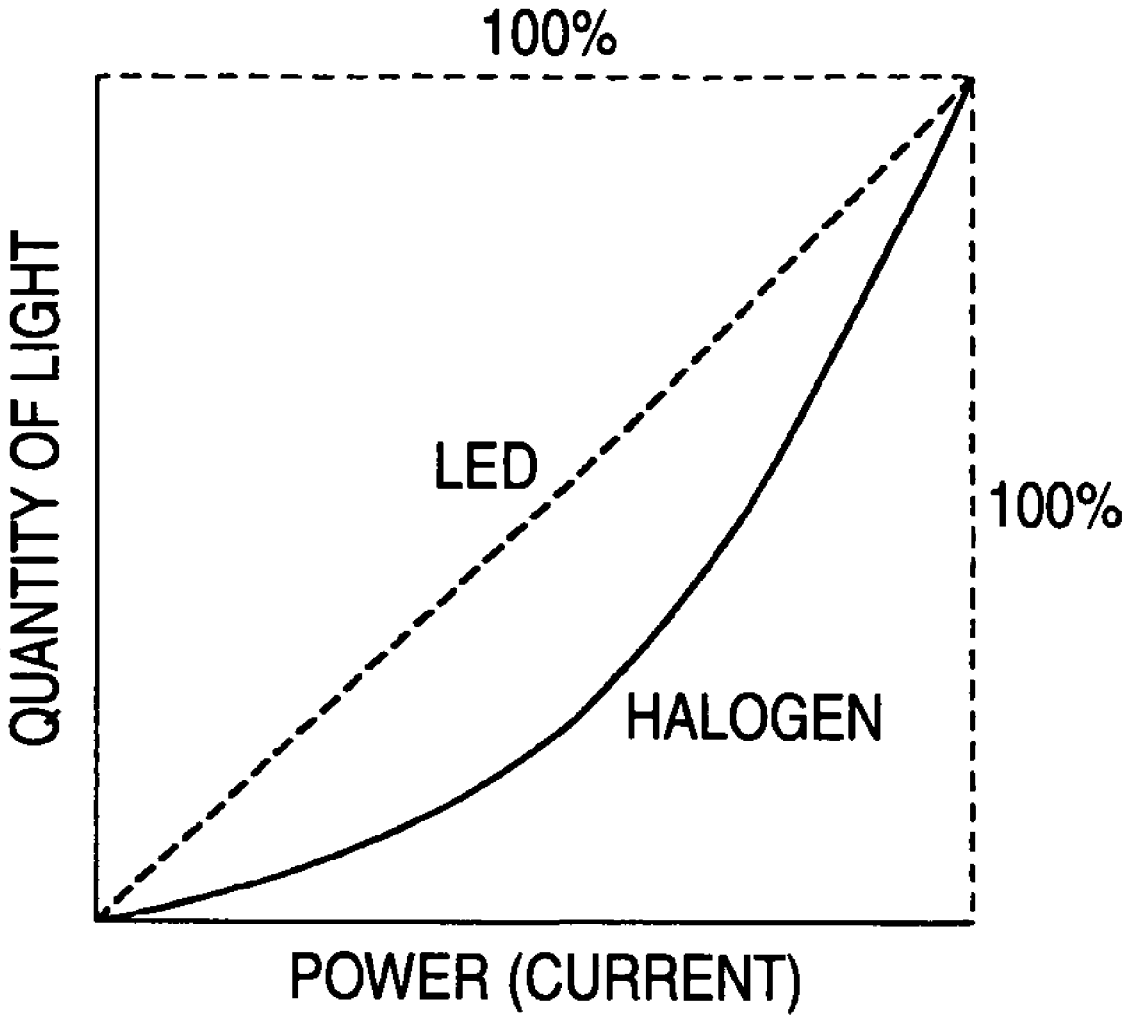
FIG. 5 A characteristic view showing a relationship between a power (current) and a quantity of light in regarding to a halogen lamp and an LED.
Figure 6:
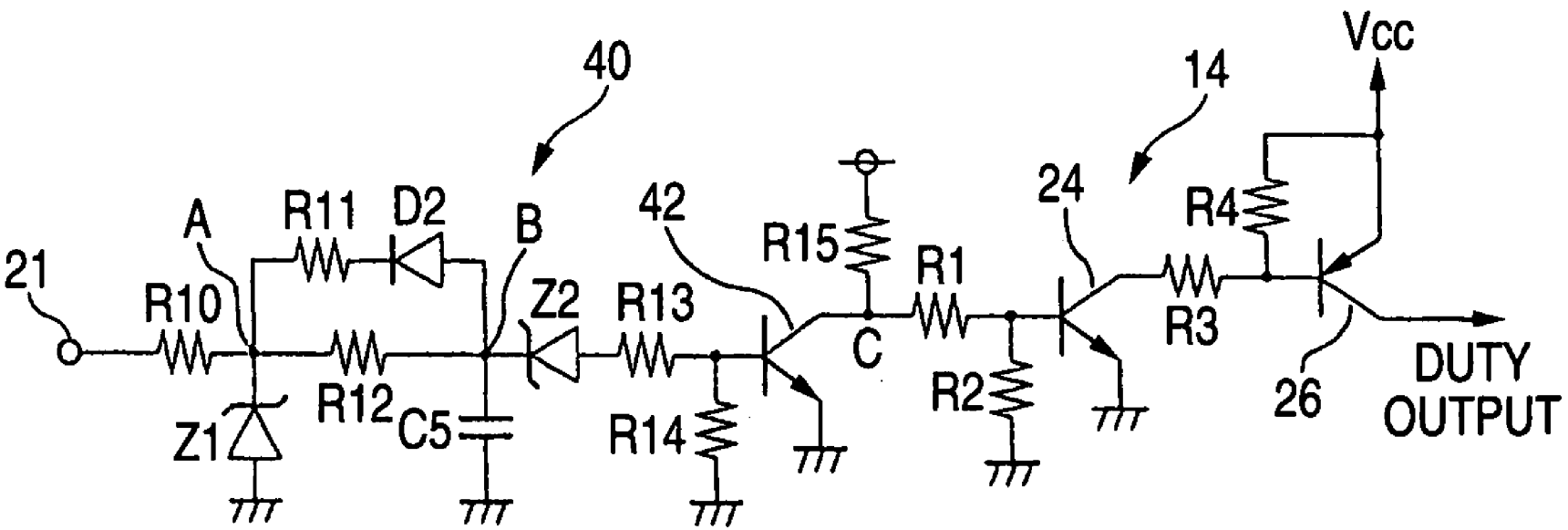
FIG. 6 A pertinent circuit diagram of a lighting control circuit for vehicle lighting equipment showing a fourth embodiment of the present invention.
Figure 8:
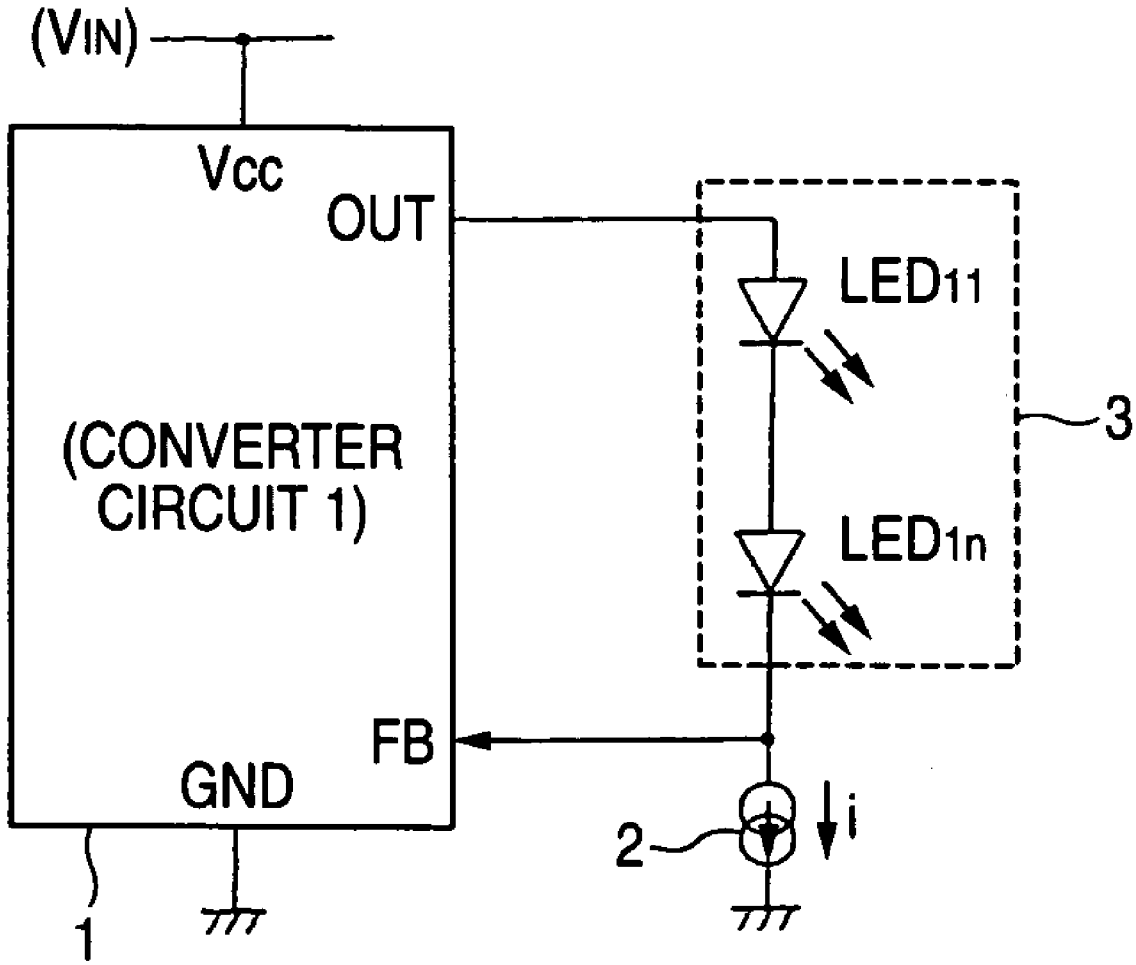
FIG. 8 A block diagram of a lighting control circuit for vehicle lighting equipment in the prior art.

Next, embodiments of the present invention will be explained with reference to examples. FIG. 1 is a circuit diagram of a lighting control circuit for vehicle lighting equipment showing a first embodiment of the present invention. FIG. 2 is a circuit diagram of a lighting control circuit for vehicle lighting equipment showing a second embodiment of the present invention. FIG. 3 is a circuit diagram of a power supply circuit. FIG. 4 is a pertinent circuit diagram of a lighting control circuit for vehicle lighting equipment showing a third embodiment of the present invention. FIG. 5 is a characteristic view showing a relationship between a power (current) and a quantity of light in regarding to a halogen lamp and an LED. FIG. 6 is a pertinent circuit diagram of a lighting control circuit for vehicle lighting equipment showing a fourth embodiment of the present invention. FIG. 7 is a waveform diagram explaining an operation of the lighting control circuit for the vehicle lighting equipment shown in FIG. 6. FIG. 8 is a block diagram of a lighting control circuit for vehicle lighting equipment in the prior art.

In these Figures, a lighting control circuit 10 for vehicle lighting equipment is constructed to include a multivibrator 12, a voltage converter circuit 14, and a power supply circuit 16, as an element of the vehicle lighting equipment. An LED 18 serving as a semiconductor light source composed of a semiconductor light emitting device is connected to the output side of the power supply circuit 16. The LED 18 can be constructed as the light source for various vehicle lighting equipments such as the headlamp, the stop and tail lamp, the fog lamp, the turn-signal lamp, and the like. Also, a single LED is illustrated as the LED 18, but a plurality of LEDs may be employed.

The multivibrator 12 has two capacitors C1, C2, and the input side thereof is connected to a control signal input terminal 20 that receives the control signal. The control signal input terminal 20 is connected to a collector of an NPN transistor 22 provided on the vehicle via a signal cable. The NPN transistor 22 is provided to a control unit that controls the lamps, etc. of the vehicle, for example, and is turned on/off in response to the control signal that consists of the binary signal having H(High)/L(Low) levels. More particularly, the NPN transistor 22 is constructed such that such transistor is turned on when an H signal is input as the control signal that is used to turn on the LED 18 in a dimmed lighting mode, and also such transistor is turned off when an L signal is input as the control signal that is used to turn on the LED 18 in a full lighting mode. When the NPN transistor 22 is turned on, the L signal is input into the control signal input terminal 20 as the control signal, and then the PWM signal as an on/off controlling signal having a designated duty ratio is output from the output side of the multivibrator 12. A frequency of a duty ratio of the PWM signal can be adjusted to any values by adjusting values of the capacitors C1, C2 and a value of a duty adjusting resistor (not shown). That is, the multivibrator 12 is constructed as a signal converting means that converts the binary signal into the PWM signal with a designated duty ratio when the NPN transistor 22 is turned on in response to the H signal of the H/L binary signals. In contrast, when the NPN transistor 22 is turned on in response to the L signal of the H/L binary signals, the drive of the multivibrator 12 is stopped and output of the PWM signal is stopped.

The voltage converter circuit 14 is constructed to have resistors R1, R2, R3, R4, an NPN transistor 24, and a PNP transistor 26. One end side of the resitor R1 is connected to the output side of the multivibrator 12. An emitter of the PNP transistor 26 is connected to the Vcc power supply, and a collector thereof is connected to a signal input terminal 28 of the power supply circuit 16. The NPN transistor 24 is maintained in its off state when a level of the PWM signal output from the multivibrator 12 is less than a set level, and is turned on when the level of the PWM signal exceeds the set level. When the NPN transistor 24 is turned on, the PNP transistor 26 is also turned on to output the voltage Vcc to the signal input terminal 28 of the power supply circuit 16.

In other words, the NPN transistor 24 and the PNP transistor 26 repeat the on/off actions in response to the duty ratio of the PWM signal being output from the multivibrator 12. When both transistors 24, 26 are turned on, a specified voltage Vcc is output to the signal input terminal 28 of the power supply circuit 16. For example, a 5 V voltage is output when the PWM signal is turned on, and a 0 V voltage is output when the PWM signal is turned off. Therefore, when the PWM signal is output from the multivibrator 12, the voltage converter circuit 14 can waveform-shape the voltage of the PWM signal into a specified voltage and then output the waveform-shaped PWM signal to the power supply circuit 16.

The power supply circuit 16 is constructed to have a switching element (not shown) that executes a switching operation in response to the PWM signal fed from the voltage converter circuit 14, and a constant-current circuit for supplying a specified current, e.g., a rated current, to the LED 18 via the switching element. Then, the power supply circuit 16 turns on the LED 18 in a dimmed lighting mode by repeating the supply of the rated current to the LED 18 and the inhibition (supply stop) thereof, for example, in response to the PWM signal as the output (Duty output) of the PNP transistor 26 in the voltage converter circuit 14. In this case, the power supply circuit 16 supplies the rated current to the LED 18 when the output (Duty output) of the PNP transistor 26 in the voltage converter circuit 14 is at a low level (OFF) as one logical level of the PWM signal, while the power supply circuit 16 stops the supply of the current to the LED 18 when the output (Duty output) of the PNP transistor 26 in the voltage converter circuit 14 is at a high level (ON) as the other logical level of the PWM signal. In other words, the voltage converter circuit 14 and the power supply circuit 16 are constructed as a current supplying means that controls the supply of the current to the LED 18 based on the PWM signal, while using an input voltage from the battery (power supply) as a luminous energy of the LED 18. According to the configuration of the power supply circuit 16, the power supply circuit 16 may supply the rated current to the LED 18 when the output (Duty output) of the PNP transistor 26 in the voltage converter circuit 14 is at the high level (ON) of the PWM signal, while the power supply circuit 16 may stop the supply of the current to the LED 18 when the output (Duty output) of the PNP transistor 26 in the voltage converter circuit 14 is at the low level (OFF) of the PWM signal.

In the present embodiment, in the situation that the LED 18 is used as the high-beam headlamp or the low-beam headlamp, when the LED 18 should be turned on in a dimmed lighting mode, such a control is repeated that the rated current is supplied to the LED 18 from the power supply circuit 16 when the PWM signal is at the low level (OFF) but the supply of the current to the LED 18 from the power supply circuit 16 is stopped when the PWM signal is at the high level (ON). Thus, the average current flowing through the LED 18 is reduced, an emission of light is weakened in contrast to that in a full lighting mode, and the LED 18 is turned on in a dimmed lighting mode, nevertheless the chromaticity of the LED 18 can be still kept white since the rated current flows through the LED 18 when the current is to be supplied to the LED 18.

FIG. 7(*a*)-(*g*) Waveform diagrams explaining an operation of the lighting control circuit for the vehicle lighting equipment shown in FIG. 6.

As shown in FIG. 3, the power supply circuit 30 is constructed to include a transformer T, capacitors C3, C4, a diode D1, an NMOS transistor 34 acting as the switching element, and a switching circuit 36 for controlling a switching operation of the NMOS transistor 34. The switching operation of the NMOS transistor 34 is controlled in such a manner that the voltage converted from the current flowing through the LED 18 via the shunt resistor R5 is fed back to the current sensing terminal 32 via the resistor R6 and then the voltage at the current sensing terminal 32 can be kept at a constant voltage, i.e., the current flowing through the LED 18 can be kept constant.

Next, embodiments of the present invention will be explained with reference to examples. FIG. 1 is a circuit diagram of a lighting control circuit for vehicle lighting equipment showing a first embodiment of the present invention. FIG. 2 is a circuit diagram of a lighting control circuit for vehicle lighting equipment showing a second embodiment of the present invention. FIG. 3 is a circuit diagram of a power supply circuit. FIG. 4 is a pertinent circuit diagram of a lighting control circuit for vehicle lighting equipment showing a third embodiment of the present invention. FIG. 5 is a characteristic view showing a relationship between a power (current) and a quantity of light in regarding to a halogen lamp and an LED. FIG. 6 is a pertinent circuit diagram of a lighting control circuit for vehicle lighting equipment showing a fourth embodiment of the present invention. FIG. 7(*a*)-(*g*) are waveform diagrams explaining an operation of the lighting control circuit for the vehicle lighting equipment shown in FIG. 6. FIG. 8 is a block diagram of a lighting control circuit for vehicle lighting equipment in the prior art.

In the present embodiment, under the condition that the LED 18 is used as the high-beam headlamp or the low-beam headlamp, when the LED 18 should be turned on in a dimmed lighting mode, such a control is repeated that the rated current is supplied to the LED 18 from the power supply circuit 16 at the low level (OFF) of the PWM signal but the supply of the current to the LED 18 from the power supply circuit 16 is stopped at the high level (ON) of the PWM signal. Therefore, the average current flowing through the LED 18 is reduced, an emission of light is weakened in contrast to that in a full lighting mode, and the LED 18 is turned on in a dimmed lighting mode, nevertheless the chromaticity of the LED 18 can be still kept white since the rated current flows through the LED 18 when the current is to be supplied to the LED 18.

Also, in the present embodiment, when the battery voltage is varied largely at the time of cracking, or the like of the vehicle and the battery voltage is extraordinarily increased or decreased, the ON state of the PNP transistor 26 can be held in a predetermined period to increase the voltage at the current sensing terminal 32, and thus the switching operation of the NMOS transistor 34 can be stopped.

Next, a third embodiment of the present invention will be explained with reference to FIG. 4. In the present embodiment, the battery voltage is divided by a resistor R8 and a resistor R9, the divided voltage is applied to a reset terminal 38 of the power supply circuit 30, and the reset terminal 38 is connected to a collector of the PNP transistor 26. Other structures are similar to those in FIG. 2.

Also, in the present embodiment, in the situation that the LED 18 is used as the high-beam headlamp or the low-beam headlamp, when the LED 18 should be turned on in a dimmed lighting mode, such a control is repeated that the rated current is supplied to the LED 18 from the power supply circuit 16 when the PWM signal is at the low level (OFF) but the supply of the current to the LED 18 from the power supply circuit 16 is stopped when the PWM signal is at the high level (ON). Thus, the average current flowing through the LED 18 is reduced, an emission of light is weakened in contrast to that in a full lighting mode, and the LED 18 is turned on in a dimmed lighting mode, nevertheless the chromaticity of the LED 18 can be still kept white since the rated current flows through the LED 18 when the current is to be supplied to the LED 18.

In the present embodiment, such a situation is simulated by turning on the PNP transistor 26 that the battery voltage is extraordinarily increased at the time of cracking, or the like of the vehicle. For the reason that an input voltage to the reset terminal 38 is in excess of a set voltage, the switching operation of the NMOS transistor 34 is stopped. Also, because it is assumed that the battery voltage is returned to the normal voltage when the PNP transistor 26 is turned off, the switching operation of the NMOS transistor 34 can be started again by releasing the reset operation.

In other words, the power supply circuit 30 in the present embodiment has a fail-safe function of stopping the switching operation of the NMOS transistor 34 as the switching element when the battery voltage is unusual, and also a reset function of starting the switching operation of the NMOS transistor 34 again when the battery voltage is returned to the normal condition from the abnormal condition.

Meanwhile, as shown in FIG. 5, a quantity of emitted light is different between the case the halogen lamp is employed as the headlamp and the case the LED is employed as the headlamp. Therefore, in case the PWM signal generated to drive the halogen lamp is employed to the lighting circuit to drive the LED, such PWM signal must be corrected by taking notice of the characteristics of the halogen lamp and the characteristics of the LED.

Therefore, as shown in FIG. 6, a control signal correcting circuit 40 serving as a control signal correcting means for correcting the duty ratio of the PWM signal to fit to the characteristics of the LED and then outputting the corrected PWM signal is provided between a PWM signal input terminal 21, into which the PWM signal is input from the vehicle side, and the voltage converter circuit 14.

The control signal correcting circuit 40 is constructed to include resistors R10, R11, R12, R13, R14, R15, Zener diodes Z1, Z2, a diode D2, a capacitor C5, and an NPN transistor 42. One end side of the resistor R10 is connected to the PWM signal input terminal 21, and a collector of the NPN transistor 42 is connected to one end side of the resistor R1.

In the control signal correcting circuit 40, when a signal having a waveform shown in FIG. 7(*a*) is input from the PWM signal input terminal 21 as the PWM signal, the PWM signal having a waveform shown in FIG. 7(*b*) (waveform at an A point) is applied across the Zener diode Z1. As shown in FIG. 7(*c*), a voltage of the PWM signal (waveform at a B point) is clamped at the Zener voltage of the Zener diode Z1. The clamped voltage is applied across the capacitor C5, and the electric charges are charged in the capacitor. Since the electric charges charged (accumulated) in the capacitor C5 are discharged only to the resistor R11 side via the diode D2, it is set that the discharge is carried out quickly and the charge is carried out slowly. Also, the voltage developed across the capacitor C5 is applied to a base of the NPN transistor 42 via the Zener diode Z2 and the resistor R13. At this time, a threshold voltage at which the NPN transistor 42 is turned on/off is enhanced by the Zener voltage of the Zener diode Z2. Then, when the voltage across the capacitor C5 exceeds the threshold voltage, the NPN transistor 42 is turned on and then the PWM signal whose phase is inverted (waveform at a C point) is output from a collector of the NPN transistor 42, as shown in FIG. 7(*d*).

A Low period of the PWM signal output from the collector of the NPN transistor 42 corresponds to a High period of the PWM signal input into the PWM signal input terminal 21, and an ON duty period is shortened. That is, the PWM signal generated to turn on the halogen lamp in a dimmed lighting mode is corrected to fit to the characteristics of the LED 18, so that the ON duty period of the PWM signal is shortened to lower the light dimming rate.

When the NPN transistor 24 and the PNP transistor 26 are turned on/off in response to the PWM signal shown in FIG. 7(*d*), the PWM signal having a waveform whose ON duty period is shortened is output from the collector of the PNP transistor 26 as the Duty output, as shown in FIG. 7(*e*). Thus, the NMOS transistor 34 acting as the switching element executes the switching action in the Low period of the PWM signal, as shown in FIG. 7(*f*). Also, only when the NMOS transistor 34 takes the switching action, the current is supplied to the LED, as shown in FIG. 7(*g*). In this case, the current that is smaller than the current fed when the PWM signal, which is input into the PWM signal input terminal 21 and then whose phase is inverted simply, is input into the voltage converter circuit 14 is supplied to the LED 18, so that the light dimming rate of the LED 18 can be lowered to meet the characteristics of the LED 18.

Also, in the present embodiment, in the situation that the LED 18 is used as the high-beam headlamp or the low-beam headlamp, when the LED 18 should be turned on in a dimmed lighting mode, such a control is repeated that the rated current is supplied to the LED 18 from the power supply circuit 16 when the PWM signal is at the low level (OFF) but the supply of the current to the LED 18 from the power supply circuit 16 is stopped when the PWM signal is at the high level (ON). Thus, the average current flowing through the LED 18 is reduced, an emission of light is weakened in contrast to that in a full lighting mode, and the LED 18 is turned on in a dimmed lighting mode, nevertheless the chromaticity of the LED 18 can be still kept white since the rated current flows through the LED 18 when the current is to be supplied to the LED 18.

Also, in the present embodiment, even when the LED 18 is turned on in a dimmed lighting mode by using the PWM signal that is generated to turn on the halogen lamp in a dimmed lighting mode, a quantity of emitted light of the LED 18 can be made equal to a quantity of emitted light of the halogen lamp.

We claim:

1. A lighting control circuit for vehicle lighting equipment, comprising:

current supplying means for controlling a supply of current to a semiconductor light source based on an on/off control signal, while using an input voltage from a power supply as a luminous energy of the semiconductor light source; and signal converting means for converting a binary signal into the on/off control signal having a designated duty ratio in response to one signal of the binary signal, and outputting the on/off control signal to the current supplying means, wherein the current supplying means supplies a specified current to the semiconductor light source when the on/off control signal is at one logical level, and stops the supply of current to the semiconductor light source when the on/off control signal is at other logical level, and current supplying means comprises a voltage converter circuit which repeats the supplying the specified current and the stopping the current in response to a duty ratio of the on/off control signal being output from the signal converting means.

2. The lighting control circuit for vehicle lighting equipment according to claim 1, further comprising:

control signal correcting means for correcting a duty ratio of the on/off control signal in response to characteristics of the semiconductor light source, and outputting the corrected on/off control signal to the current supplying means.

* * * * *